US011037473B2

(12) United States Patent
Kenton et al.

(10) Patent No.: US 11,037,473 B2
(45) Date of Patent: Jun. 15, 2021

(54) MODULAR SIGN

(71) Applicant: Yardbird Outside, LLC, Austin, TX (US)

(72) Inventors: Sara Kenton, Austin, TX (US); Jake Hillard, Plainville, KS (US)

(73) Assignee: Yardbird Outside, LLC, Austin, TX (US)

( * ) Notice: Subject to any disclaimer, the term of this patent is extended or adjusted under 35 U.S.C. 154(b) by 0 days.

(21) Appl. No.: 16/818,624

(22) Filed: Mar. 13, 2020

(65) Prior Publication Data

US 2020/0294429 A1 Sep. 17, 2020

Related U.S. Application Data

(60) Provisional application No. 62/819,245, filed on Mar. 15, 2019.

(51) Int. Cl.
*G09F 15/00* (2006.01)
*G09F 21/00* (2006.01)

(52) U.S. Cl.
CPC ..... *G09F 15/0056* (2013.01); *G09F 21/00* (2013.01)

(58) Field of Classification Search
CPC ..... G09F 15/0056; G09F 21/00
See application file for complete search history.

(56) References Cited

U.S. PATENT DOCUMENTS 3,380,428 A * 4/1968 Abrams ..... E01F 9/688 116/63 P
D307,606 S * 5/1990 Jervis, Sr. ..... D20/31
5,220,740 A * 6/1993 Brault ..... F16M 11/42 40/606.02
D388,724 S * 1/1998 Victor ..... D10/109.1
5,860,386 A * 1/1999 Schwab ..... B60Q 7/00 116/63 C
5,875,578 A * 3/1999 Grewe ..... G09F 15/0056 248/346.2
7,140,581 B1 * 11/2006 White ..... E04H 12/2246 248/129
8,887,423 B1 * 11/2014 Morgan ..... G09F 13/00 40/612
2006/0117624 A1 * 6/2006 Hillstrom ..... G09F 15/0056 40/607.01
2006/0137231 A1 * 6/2006 Phillips ..... G09F 15/0056 40/430
2007/0241255 A1 * 10/2007 Dvoracek ..... G09F 15/0056 248/346.01
2009/0183408 A1 * 7/2009 Dicke ..... E01F 9/688 40/610
2012/0066947 A1 * 3/2012 Glass, Jr. ..... G09F 15/0056 40/606.02
2018/0122279 A1 * 5/2018 Calby ..... G09F 15/0056

* cited by examiner

*Primary Examiner* — Gary C Hoge
(74) *Attorney, Agent, or Firm* — Banner & Witcoff, Ltd.

(57) ABSTRACT

A modular sign may comprise a base portion and an upright portion. The base portion may include an upright portion aperture in a top surface of the base. The upright portion may include an interlocking portion forming a lower end of the upright portion. The interlocking portion is configured to be inserted into the upright portion aperture of the base portion.

20 Claims, 9 Drawing Sheets

MODULAR SIGN

CROSS REFERENCE TO RELATED APPLICATIONS

This application claims benefit to U.S. Provisional Application No. 62/819,245 filed Mar. 15, 2020 which is incorporated herein fully by reference.

FIELD

The present disclosure relates broadly to sign systems, and more specifically to modular signs.

BACKGROUND

Outdoor activities are enjoyed by people of all ages. These people, however, must share the outdoor space. Therefore in some circumstances it may be necessary to alert certain individuals that others, including children, are outside in a particular area. Systems are necessary to alert certain individuals such as drivers, bikers, and even aggressive pedestrians, that others are in the area.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of the disclosure herein relate to signs and particularly to modular signs. In one embodiment a modular sign may comprise a base portion, the base portion may include an upright portion aperture in a top surface of the base; and an upright portion, the upright portion may include an interlocking portion forming a lower end of the upright portion. The interlocking portion is configured to be inserted into the upright portion aperture of the base portion.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different components of various examples; however, the disclosed examples are not limited to that particular scale.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure.

Also, while the terms "top," "bottom," "front," "back," "side," "rear," "upward," "downward," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this disclosure. Also, the reader is advised that the attached drawings are not necessarily drawn to scale.

In general, aspects of this disclosure relate to sign systems and in particular to modular signs. According to various aspects and embodiments, the modular signs discussed herein may be formed of one or more of a variety of materials, such as metals (including metal alloys), plastics, polymers, and composites, and may be formed in one of a variety of configurations, without departing from the scope of the disclosure.

When the same reference number appears in more than one drawing, that reference number is used consistently in this specification and the drawings to refer to the same or similar parts throughout.

Aspects of this disclosure relate to a modular sign 100 having a removable sign portion 102. FIGS. 1-5 show various views of the modular sign 100. The modular sign 100 includes a base portion 200 and an upright portion 300. As will be discussed in greater detail below, the base portion 200 is separable from the upright portion 300. Advantageously, because the base portion 200 is separable from the upright portion 300 a user may more easily be able to store and/or ship the modular sign 100. As shown in FIGS. 1-5 the modular sign is generally shaped to resemble a child holding a sign with one hand raised, however, the modular sign 100 may be formed using other shapes.

Figure 1:
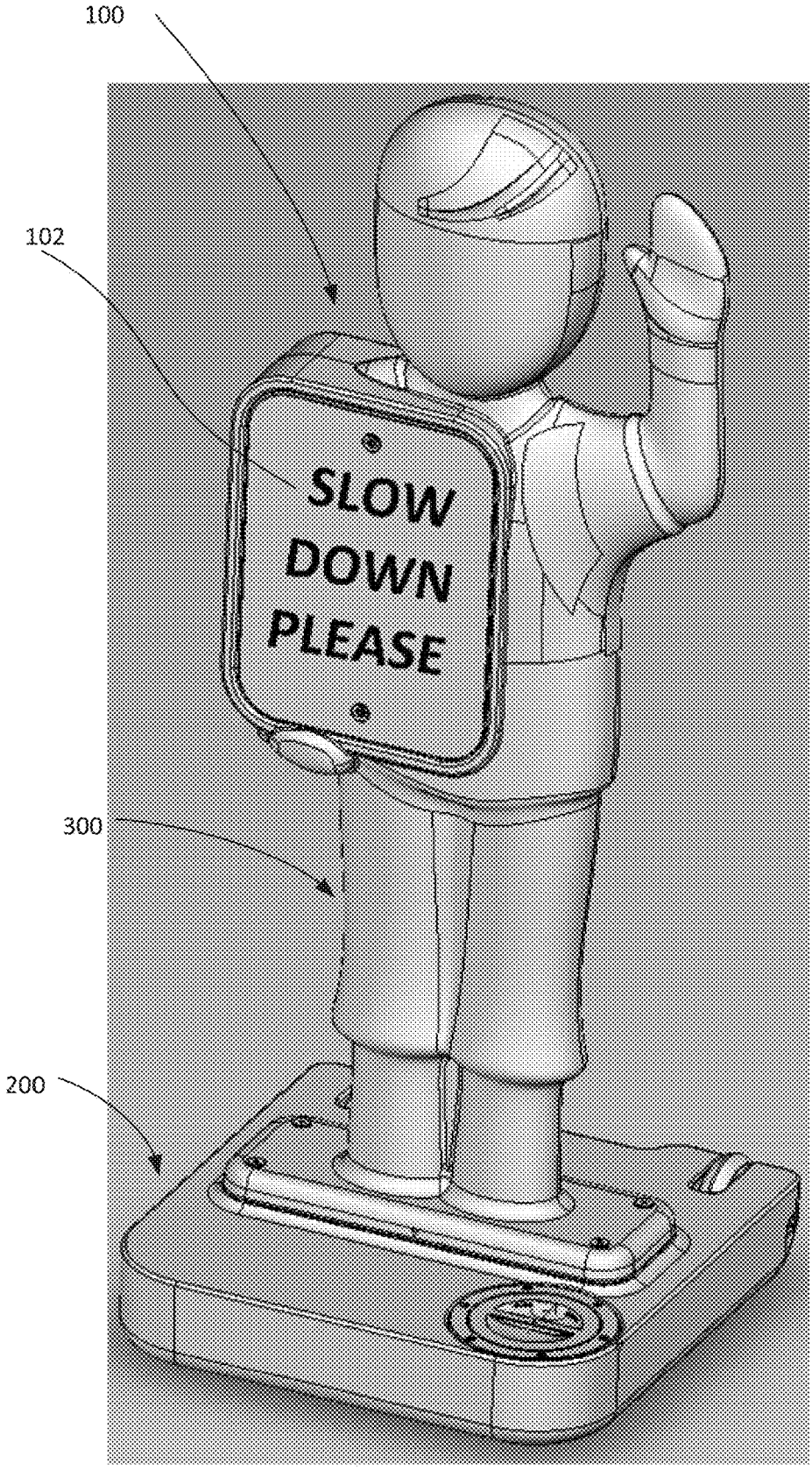
FIG. 1 depicts an isometric view of an example modular sign with a sign portion attached, according to one or more aspects described herein.

As shown in FIG. 1, the modular sign 100 also includes a sign portion 102. The sign portion 102 may be connected to the upright portion 300 using any suitable removable means including mechanical fasteners, such as screws or bolts, and hook and loop systems. The sign portion 102 may be modular such that many different sign portions 102 displaying many different messages may be attached to the modular sign 100. For example, as shown in FIG. 1 the sign portion 102 may display a "Please Slow Down" message. The sign portion may be replaced with signs showing many different messages. In one example, the sign portion 102 may be an electronic sign capable of playing video or other digital messages.

Figure 6:
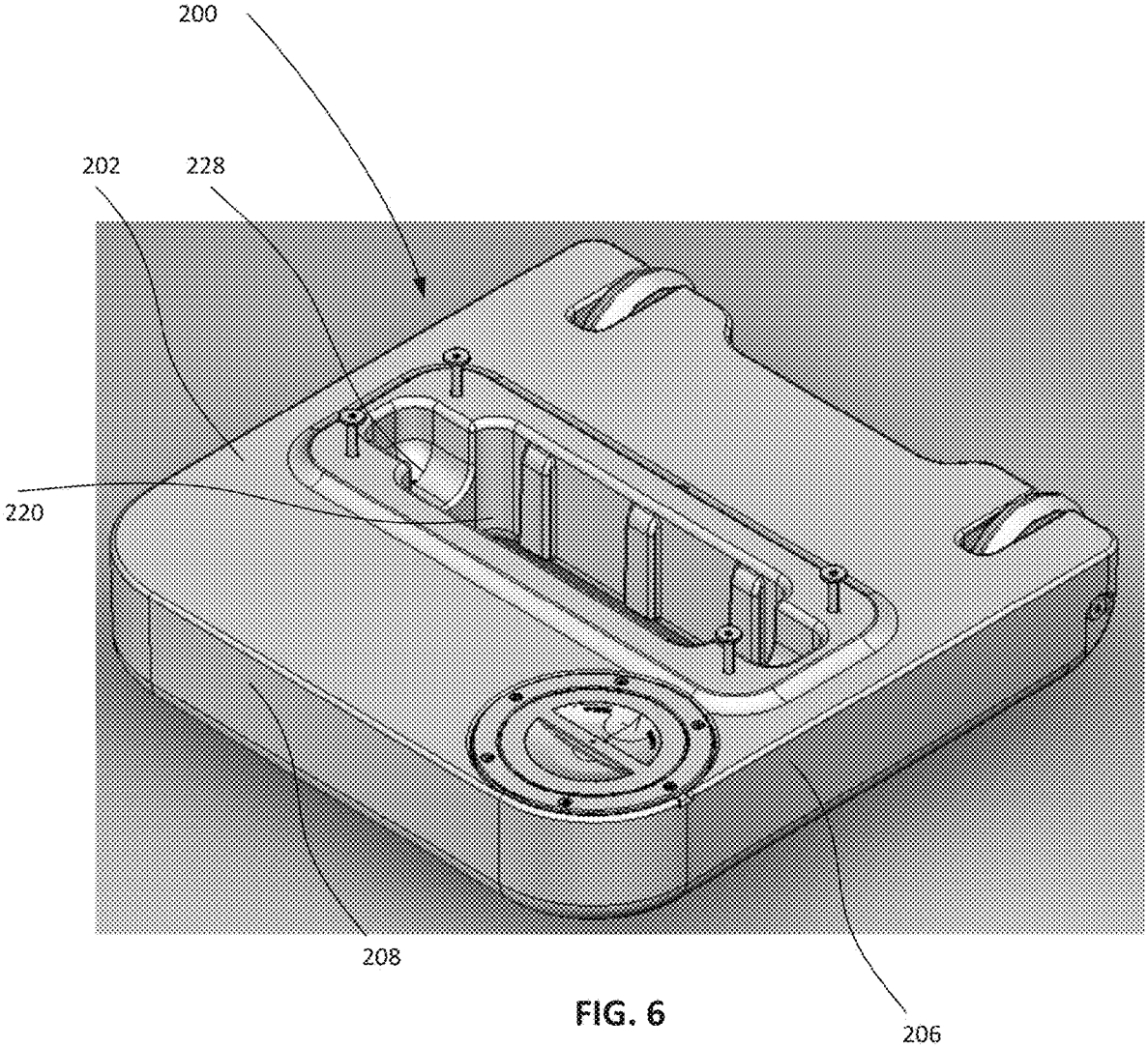
FIG. 6 depicts an isometric view of an example base of a modular sign, according to one or more aspects described herein.
Figure 7A:
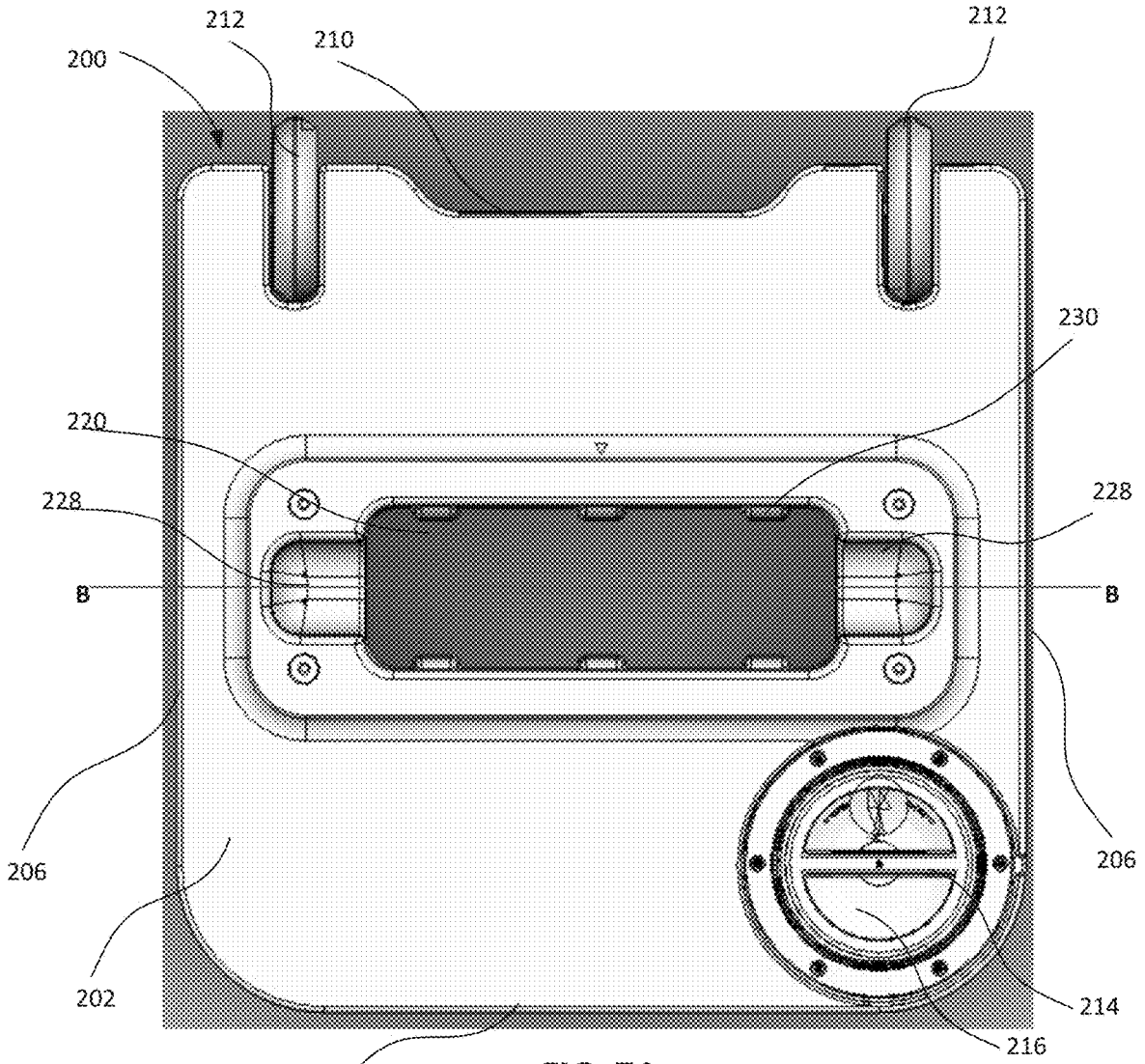
FIG. 7A depicts a top view of the base of the modular sign of FIG. 6
Figure 7B:
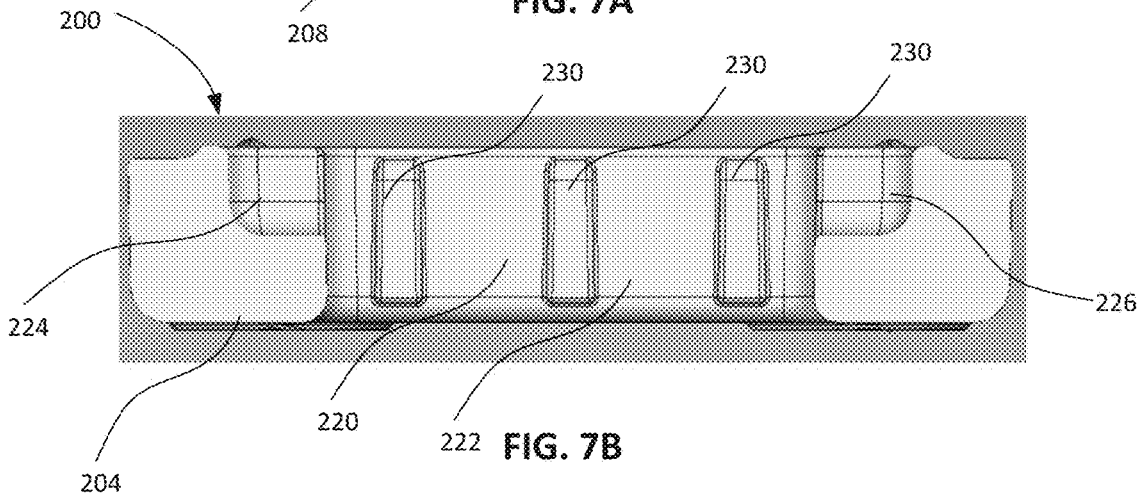
FIG. 7B depicts a side cross-sectional view of the base of the modular sign taken along line B-B of FIG. 7A.

Referring now to FIGS. 6-7B, the base portion 200 is shown separate from the upright portion 300. As shown in FIGS. 6-7B, the base portion 200 includes a top surface 202, a bottom surface 204, side surfaces 206, a front surface 208, and a back surface 210. As shown in FIGS. 6-7B the base portion 200 also includes an upright portion aperture 220. The upright portion aperture 220 may be formed in the top surface 202 of the base and it may extend completely through the base portion 200 as shown in FIG. 7B. In other embodiments, however, the upright portion aperture 220 does not extend completely through the base portion 200. As will be described in more detail below, the upright portion aperture 220 provides a location for the upright portion 300 to be inserted into the base portion 200 such that the upright portion 300 and the base portion 200 may be engaged together.

As shown in FIGS. 6-7B, the base portion 200 may also include at least one wheel 212. The at least one wheel 212 may be configured such that a user can tilt the modular sign 100 and the at least one wheel 212 (or wheels) will touch the ground but no other portion of the modular sign 100 or base will touch the ground. Advantageously, this may allow the user to roll or otherwise more easily move the modular sign 100 from one place to another. Additionally, as best shown in FIG. 7A, the at least one wheel may extend beyond a portion (such as the back or bottom) of the base 200. The at last one wheel 212 may comprise one wheel, two wheels, or more wheels.

In some embodiments, the modular sign 100 may be formed such that it is hollow. In certain circumstances a user may wish to add additional weight to the base portion 200. As shown in FIG. 7A, the modular sign 100 may include a weight fill aperture 214 having a cover 216. The weight fill aperture 214 may be formed on the top portion 202 of the base 200 and the weight fill aperture 214 may be configured such that a user can access the hollow portion of the base to add weight to the base. In some embodiments, a user may add sand or water to the base portion 200, but other materials may be added.

As discussed above, the base portion 200 includes an upright portion aperture 220 for connecting the upright portion 300 to the base portion. In some embodiments, the upright portion aperture 220 may have a center portion 222, a first side portion 224, and a second side portion 226. As shown in FIG. 7B, the center portion 222 of the upright portion aperture 220 may extend deeper than the first side portion 224 and the second side portion 226 of the upright portion aperture 220 and advantageously in some embodiments such a configuration may provide increased strength to the modular sign 100. For example, in some embodiments the ratio of the depth of the side portions 224, 226 to the depth of the center portion 220 measured from the top surface 202 toward the bottom surface 204 may be about 1:1.95 or in the range of about 1:1.75 to about 1:2.25. Additionally, as best shown in FIG. 7A, the center portion 222 may be wider than the first side portion 224 and the second side portion 226 of the upright portion aperture 220. For example, in some embodiments the ratio of the width of the side portions 224, 226 to the width of the center portion 220 measured in a front to back direction may be about 1:1.75 or may be in the range of about 1:1.5 to about 1:2.0.

In some embodiments the upright portion aperture 220 may have additional characteristics that may allow the upright portion 300 and the base portion 200 to engage each other. For example, in some embodiments, the first side portion 224 and the second side portion 226 of the upright portion aperture 220 may have a curved upper surface 228. Additionally, in some embodiments the base portion 200 may include at least one rib 230. As shown in FIG. 7A the base portion may include six ribs 230. These ribs may allow the base 200 and the upright portion 300 to more easily or fully engage each other. In other embodiments (not shown) similar ribs may be included on the interlocking portion 310 of the upright portion 300.

Additionally, in some embodiments the base portion 200 may include a number of additional features. For example, in some embodiments, the base portion 200 may include a raised lip 240 surrounding the upright portion aperture 220.

Figure 8:
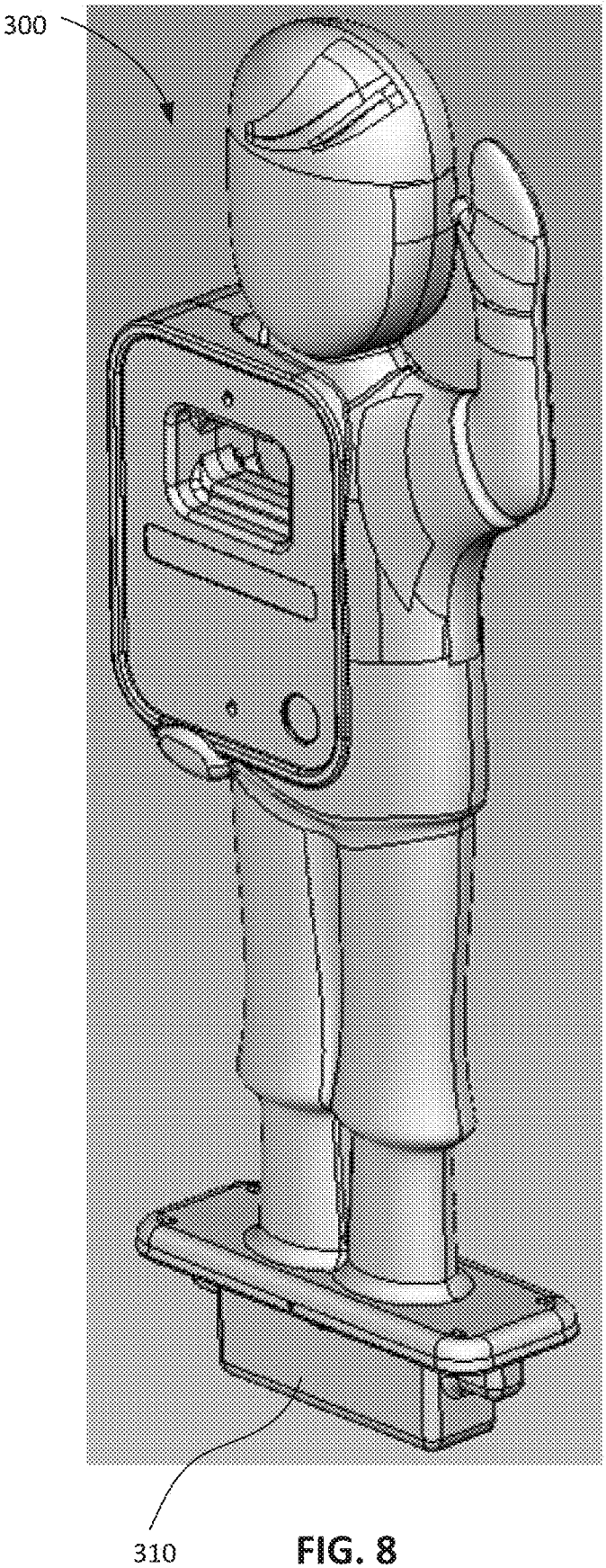
FIG. 8 depicts an isometric view of an example upright portion of a modular sign, according to one or more aspects described herein.
Figure 9A:
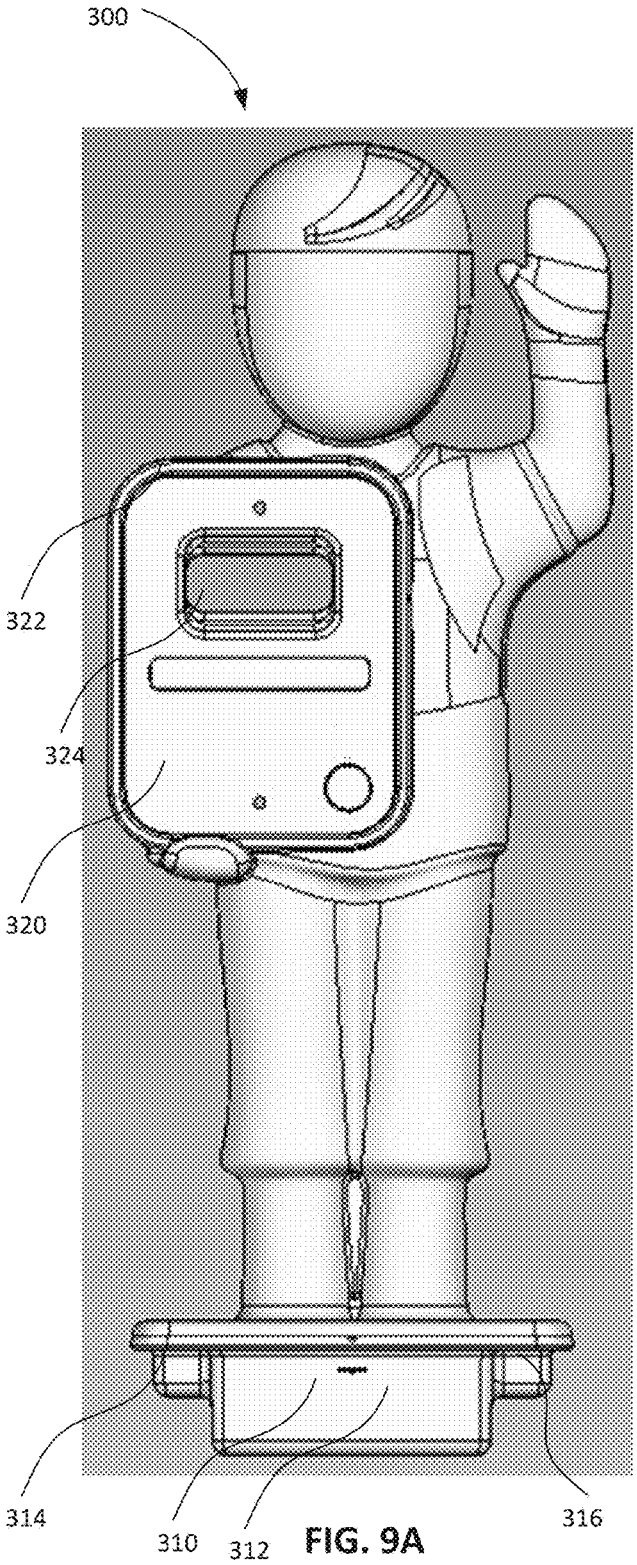
FIG. 9A depicts a front view of the upright portion of a modular sign shown in FIG. 8.
Figure 9B:
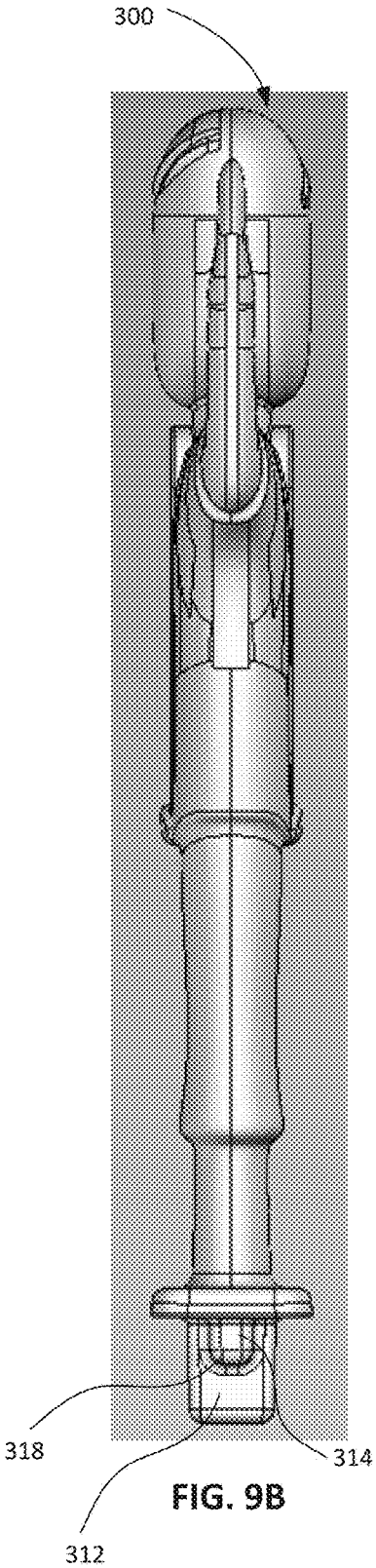
FIG. 9B depicts a side view of the upright portion of a modular sign shown in FIG. 8.

Referring now to FIGS. 8-9B, the upright portion 300 is shown separate from the base portion 300. As shown in 8-9B, the upright portion 300 may include an interlocking portion 310 forming a lower end of the upright portion 300. The interlocking portion 310 may be configured to be inserted into the upright portion aperture 220 of the base portion 200. In some embodiments, and as shown in FIGS. 8-9B, the interlocking portion 310 has a complementary shape to the upright portion aperture 220. Additionally, mechanical fasteners, such as screws or bolts, may also be used to engage the upright portion 300 to the base portion 200.

The interlocking portion 310 may have a center portion 312, a first side portion 314, and a second side portion 316. The center portion 312 of the interlocking portion 310 may extend further downward than the first side portion 314 and the second side portion 316 of the interlocking portion 310. Additionally, the center portion 312 of the interlocking portion 310 may be wider than the first side portion 314 and the second side portion 316 of the interlocking portion 310. Additionally, and as best shown in FIG. 9B, the first side portion 314 and the second side portion 316 of the interlocking portion 310 have a curved lower surface 318.

As discussed above, the modular sign 100 may be configured to hold a sign 102. Thus, the upright portion 300 may include a first sign holding portion 320. The first sign holding portion 320 may be configured to engage a sign 102. In some embodiments the first sign holding portion 320 may include a raised lip 322 around the outer periphery of the first sign holding portion 320.

In some embodiments, the modular sign 100 may also include a first a handle aperture 324. As shown in FIG. 9A, the first a handle aperture 324 may be included within the first sign holding portion 320. As best shown in FIG. 1, the first handle aperture 324 may be concealed when a sign 102 is secured in the first sign holding portion 320. In some embodiments, and as shown in FIG. 9A, the first handle aperture 324 may extend completely through the upright portion 300. In other embodiments, however, the first handle aperture 324 may not extend completely through the upper portion 300.

Figure 2:
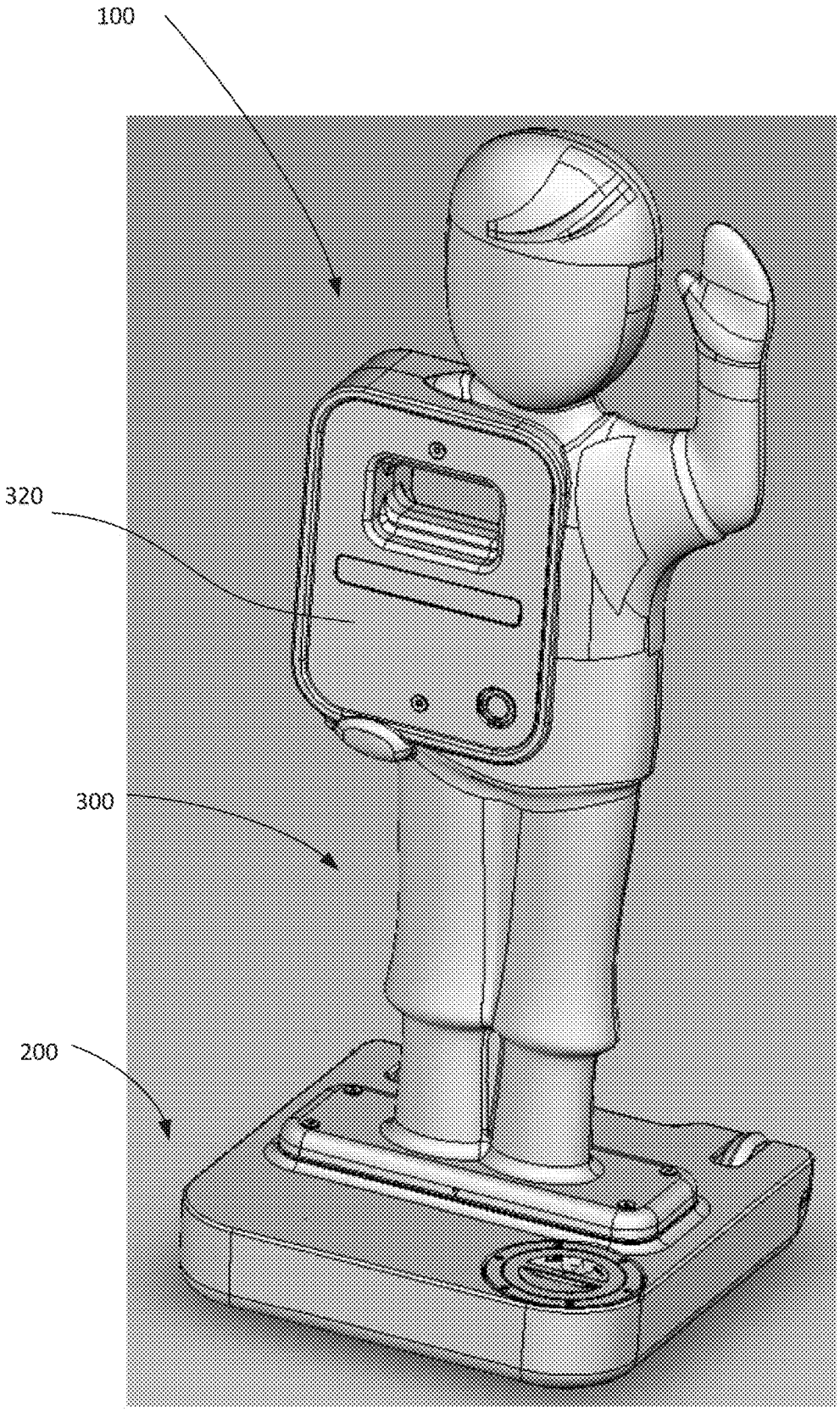
FIG. 2 depicts an isometric view of an example modular sign without a sign portion attached, according to one or more aspects described herein.
Figure 3:
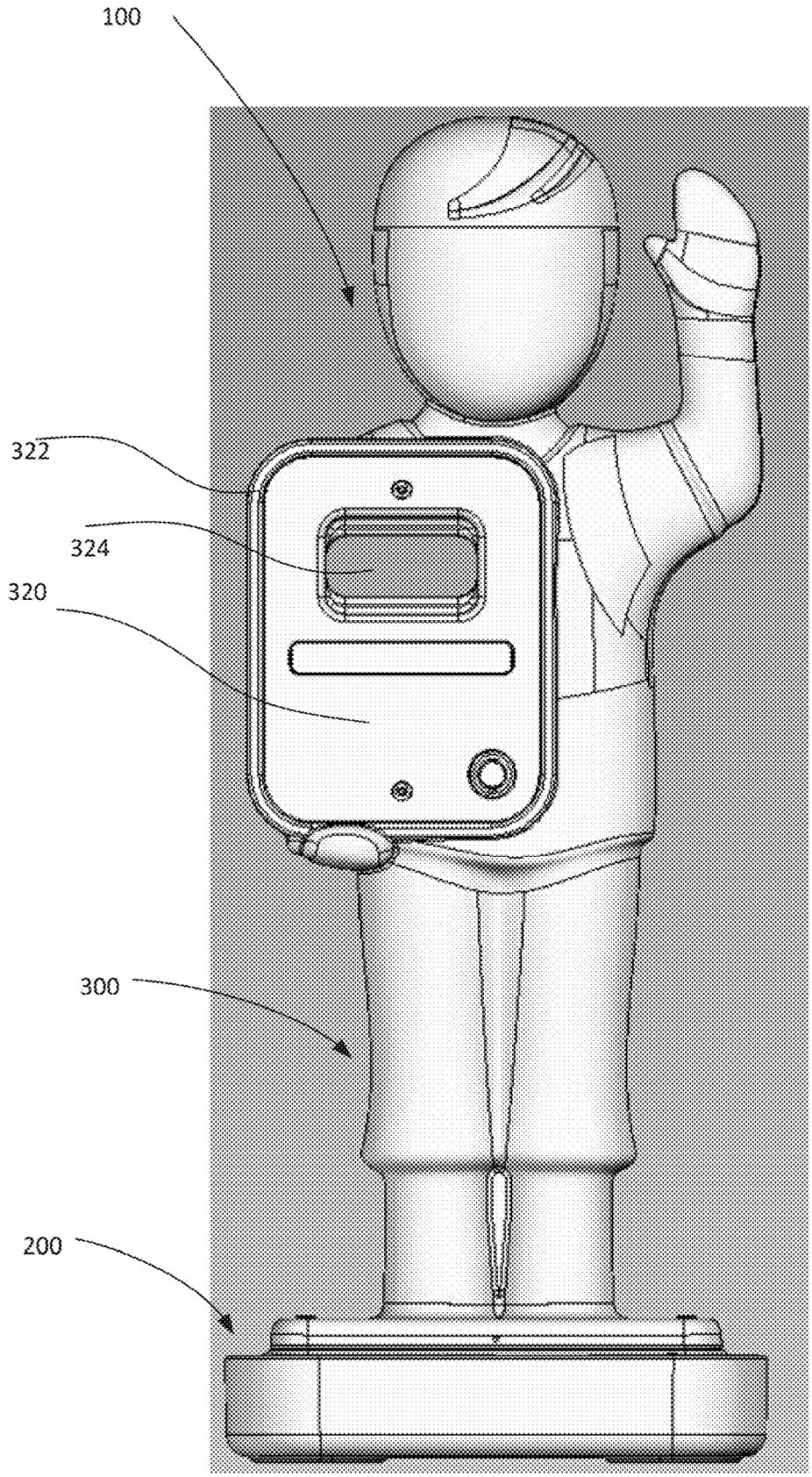
FIG. 3 depicts a front view of the modular sign shown in FIG. 2.
Figure 4:
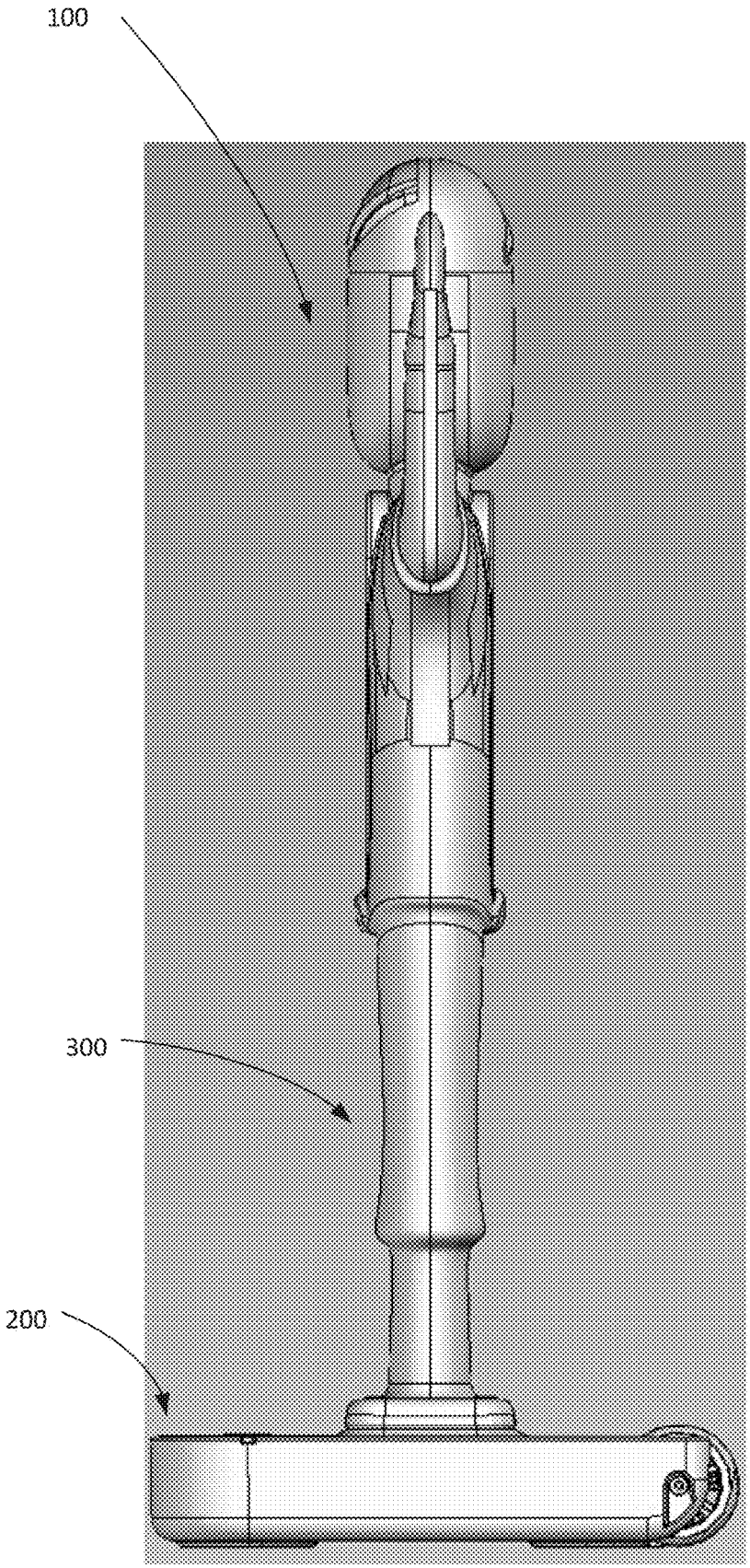
FIG. 4 depicts a side view of the modular sign shown in FIG. 2.
Figure 5:
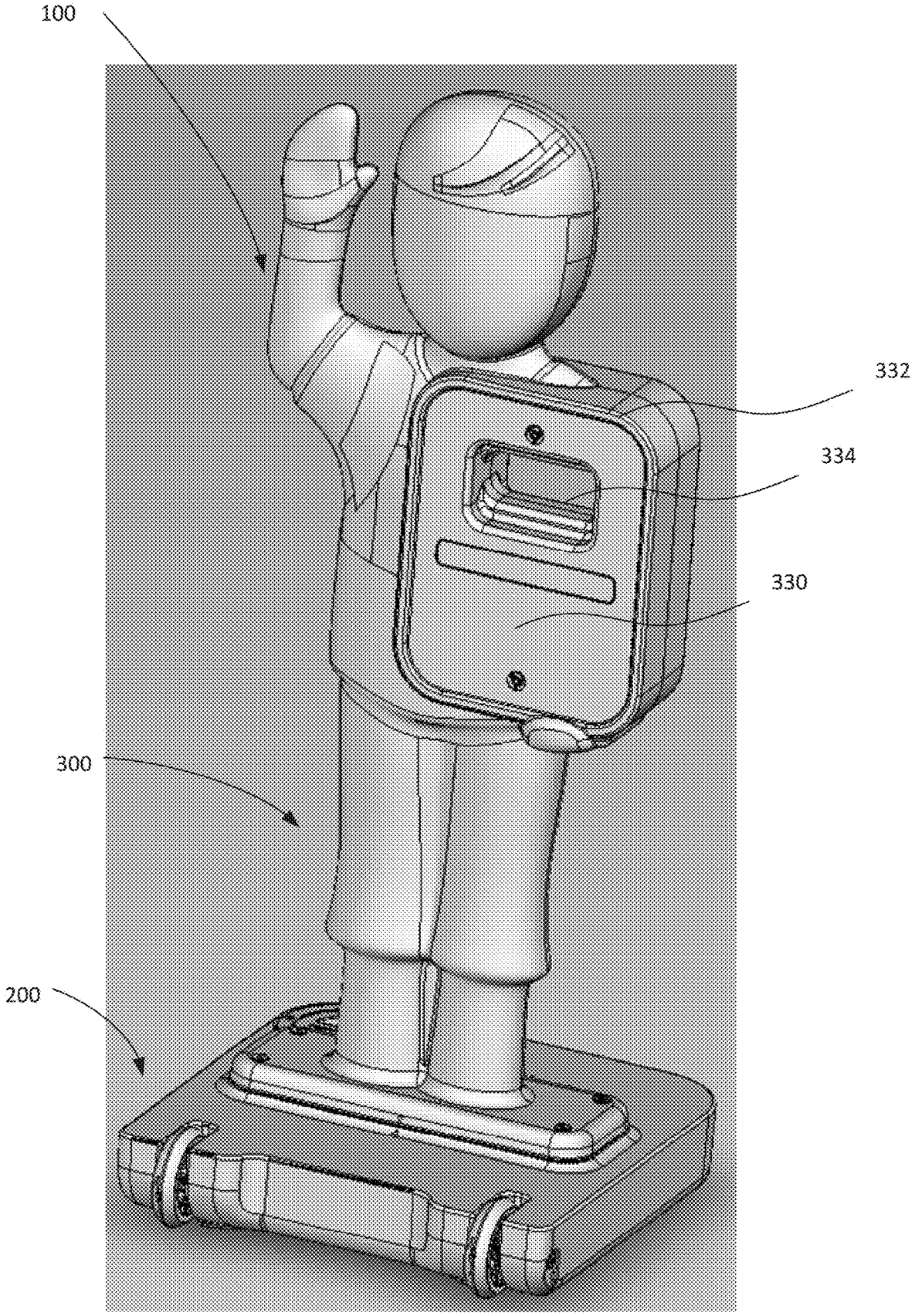
FIG. 5 depicts a back isometric view of the modular sign shown in FIG. 2.

As best shown in FIGS. 2 and 5, the modular sign 100 may include a second sign holding portion 330 opposite the first sign holding portion 320. Advantageously the second sign holding portion 330 allows a user to engage signs 102 with both sides of the modular sign 100 which allows a user to display messages on opposite sides of the sign 100. Similar to the first sign holding portion the second sign holding portion may include a similar raised lip 332 and a second handle aperture 334.

The modular sign 100 (including its components 200, 300) may be formed using any reasonable method. In some embodiments, for example, the modular sign may be formed using injection molding and/or rotomolding.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

The invention claimed is:

1. A modular sign comprising:

a base portion having a hollow portion, the base portion comprising:

an upright portion aperture in a top surface of the base;

a least one wheel extending from a side or bottom of the base and configured such that a user may tilt modular sign and the at least one wheel will touch the ground but no other portion of the base will touch the ground;

a weight fill aperture on a top portion of the base configured such that a user can access the hollow portion of the base to add weight to the base;

an upright portion having a center portion and a first side portion and a second side portion, the upright portion comprising:

an interlocking portion forming a lower end of the upright portion, the interlocking portion configured to be inserted into the upright portion aperture of the base portion;

a first sign holding portion;

a raised lip around an outer periphery of the first sign holding portion;

a first handle aperture in the first sign holding portion;

wherein the first handle aperture is concealed when a sign is secured in the first sign holding portion.

2. The modular sign of claim 1, wherein a center portion of the upright portion aperture extends deeper than a first side portion and a second side portion of the upright portion aperture.

3. The modular sign of claim 1, wherein a center portion of the upright portion aperture is wider than a first side portion and a second side portion of the upright portion aperture.

4. The modular sign of claim 1, wherein a first side portion and a second side portion of the upright portion aperture have a curved upper surface.

5. The modular sign of claim 1, wherein a center portion of the upright portion aperture extends through a bottom surface of the base portion.

6. The modular sign of claim 1, wherein the upright portion aperture comprises at least one rib.

7. The modular sign of claim 1, wherein the base portion includes a raised lip surrounding the upright portion aperture.

8. The modular sign of claim 1, wherein the interlocking portion has a complementary shape to the upright portion aperture.

9. The modular sign of claim 1, wherein the interlocking portion further comprises:

a center portion and a first side portion and a second side portion.

10. The modular sign of claim 9, wherein the center portion of the interlocking portion extends further than the first side portion and the second side portion of the interlocking portion.

11. The modular sign of claim 10, wherein the center portion of the interlocking portion is wider than the first side portion and the second side portion of the interlocking portion.

12. The modular sign of claim 11, wherein the first side portion and the second side portion of the interlocking portion have a curved lower surface.

13. The modular sign of claim 1, wherein the first handle aperture extends completely through the upright portion.

14. The modular sign of claim 1, wherein the upright portion further comprises:

a second sign holding portion opposite the first sign holding portion.

15. The modular sign of claim 14, wherein the second sign holding portion further comprises:

a raised lip around an outer periphery of the second sign holding portion.

16. The modular sign of claim 15, wherein the second sign holding portion further comprises:

a second handle aperture in the second sign holding portion.

17. The modular sign of claim 16, wherein the second handle aperture is concealed when a sign is secured in the second sign holding portion.

18. The modular sign of claim 17, wherein the handle aperture and the second handle aperture form a single aperture extending completely through the first sign holding portion and the second sign holding portion.

19. A modular sign comprising:

a base portion having a hollow portion, the base portion comprising:

an upright portion aperture in a top surface of the base;

a least one wheel extending from a side or bottom of the base and configured such that a user may tilt modular sign and the at least one wheel will touch the ground but no other portion of the base will touch the ground;

a weight fill aperture on a top portion of the base configured such that a user can access the hollow portion of the base to add weight to the base;

an upright portion having a center portion and a first side portion and a second side portion, the upright portion comprising:

an interlocking portion forming a lower end of the upright portion, the interlocking portion having a center portion and a first side portion and a second side portion, and the interlocking portion configured to be inserted into the upright portion aperture of the base portion;

a first sign holding portion;

a raised lip around an outer periphery of the first sign holding portion;

a first handle aperture in the first sign holding portion;

a second sign holding portion opposite the first sign holding portion;

a raised lip around an outer periphery of the second sign holding portion;

a second handle aperture in the second sign holding portion;

wherein the first handle aperture is concealed when a sign is secured in the first sign holding portion;

wherein the second handle aperture is concealed when a sign is secured in the second sign holding portion; and wherein the handle aperture and the second handle aperture form a single aperture extending completely through the first sign holding portion and the second sign holding portion.

20. The modular sign of claim 19, wherein a center portion of the upright portion aperture extends deeper than a first side portion and a second side portion of the upright portion aperture;

wherein the center portion of the upright portion aperture is wider than the first side portion and the second side portion of the upright portion aperture;

wherein the first side portion and the second side portion of the upright portion aperture have a curved upper surface;

wherein the center portion of the upright portion aperture extends through a bottom surface of the base portion;

wherein the upright portion aperture comprises at least one rib;

wherein the base portion includes a raised lip surrounding the upright portion aperture;

wherein the interlocking portion has a complementary shape to the upright portion aperture;

wherein the center portion of the interlocking portion extends further than the first side portion and the second side portion of the interlocking portion;

wherein the center portion of the interlocking portion is wider than the first side portion and the second side portion of the interlocking portion; and wherein the first side portion and the second side portion of the interlocking portion have a curved lower surface.

* * * * *